United States Patent [19]

Murakami et al.

[11] Patent Number: 4,746,884

[45] Date of Patent: May 24, 1988

[54] YIG THIN FILM MICROWAVE APPARATUS

[75] Inventors: Yoshikazu Murakami, Kanagawa; Hideo Tanaka; Masami Miyake, both of Miyagi; Seigo Ito, Tokyo; Hitoshi Tamada; Toshiro Yamada, both of Kanagawa, all of Japan

[73] Assignee: Sony Corporation, Tokyo, Japan

[21] Appl. No.: 883,603

[22] Filed: Jul. 9, 1986

[30] Foreign Application Priority Data

Jul. 9, 1985 [JP] Japan ..... 60-150430
Feb. 28, 1986 [JP] Japan ..... 61-43206

[51] Int. Cl.[4] ..... H01P 7/00; H01P 7/08

[52] U.S. Cl. ..... 333/234; 333/202; 333/235; 333/245

[58] Field of Search ..... 333/24.1, 24.2, 202–212, 333/219, 227–235, 238, 245, 246, 248; 331/96, 107 DD, 107 SL, 117 D; 335/209, 215, 217, 221, 216, 296–298

[56] References Cited

U.S. PATENT DOCUMENTS 4,096,461 6/1978 Roschmann ..... 333/219 X
4,516,096 5/1985 Doyen ..... 333/219

*Primary Examiner*—Marvin L. Nussbaum
*Attorney, Agent, or Firm*—Hill, Van Santen, Steadman & Simpson

[57] ABSTRACT

Disclosed is a YIG thin film device utilizing ferrimagnetic resonance effect, a magnetic circuit having a gap of length lg where the YIG thin film device being provided and applying a bias magnetic field perpendicular to a film surface of the YIG thin film device, the magnetic circuit including a permanent magnet having a thickness lm and a soft magnetic plate having a thickness lx, the permanent magnet satisfying the characteristics $$Br^o > (fo/\gamma) + Nz^Y 4\pi Mso^Y$$

$$\alpha_1{}^B > \frac{Nz^Y 4\pi Mso^Y}{(fo/\gamma) + Nz^Y 4\pi Mso^Y} \cdot \alpha_1{}^Y$$

the soft magnetic plate satisfying the characteristics $$4\pi Mso^X < (fo/\gamma) + Nz^Y 4\pi Mso^Y$$

$$\alpha_1{}^x < \frac{Nz^Y 4\pi Mso^Y}{(fo/\gamma) + Nz^Y 4\pi Mso^Y} \cdot \alpha_1{}^Y$$

wherein fo is resonance frequency of the YIG thin film device, $\gamma$ is gyromagnetic ratio of the YIG thin film $Nz^Y$ is demagnetization factor of the YIG thin film $4\pi Mso^Y$ is saturation magnetization of the YIG thin film at room temperature, $4\pi Mso^x$ is saturation magnetization of the soft magnetic plate, $Br^o$ is remanence of the permanent magnet at room temperature, $\alpha_1{}^B$ is first order temperature coefficient of the remanence of the permanent magnet near room temperature, $\alpha_1{}^Y$ is first order temperature coefficient of the saturation magnetization of the YIG thin film near room temperature, $\alpha_1{}^x$ is first order temperature coefficient of the saturation magnetization of the soft magnetic plate near room temperature and, the thickness lm and lx being selected to improve temperature dependency of the resonance frequency.

2 Claims, 6 Drawing Sheets

YIG THIN FILM MICROWAVE APPARATUS

BACKGROUND OF THE INVENTION

The present invention relates to a YIG (yttrium iron garnet) thin film microwave apparatus including means for applying a D.C. bias magnetic field to a microwave device using ferrimagnetic resonance of a YIG thin film.

There has been proposed a microwave apparatus such as a filter and an oscillator which utilizes ferrimagnetic resonance of a YIG thin film as a ferrimagnetic material formed on a GGG (gadrinium gallium garnet) non-magnetic substrate by liquid phase epitaxial growth (which will be hereinafter referred to as LPE) and worked in a desired shape such as a circular or rectangular shape by selective etching with a photolithography technique. The microwave apparatus makes it possible to form a microwave integrated circuit with a transmission line such as a micro-strip line, and easily effect hybrid connection with another microwave integrated circuit. Further, since the microwave apparatus utilizing magnetic resonance of the YIG thin film may be prepared by the LPE and the photolithography technique as mentioned above, mass productivity is improved.

As mentioned above, the microwave apparatus utilizing magnetic resonance of the YIG thin film has practical advantages over a conventional magnetic resonance device using a YIG sphere.

However, in the microwave apparatus utilizing ferrimagnetic resonance of the YIG thin film as aforementioned, ferrimagnetic resonance frequency f of the YIG thin film is largely dependent upon temperature T. Therefore, there arises a significant problem in practical use that temperature characteristics are not satisfactory.

Such a problem will be described below. The ferrimagnetic resonance frequency f of the YIG thin film may be expressed in the following manner by using a Kittel's equation, provided that an anisotropy field contribution to the resonance frequency is small enough to be neglected.

$$f(T)=\gamma\{Hg(T)-Nz^{Y}4\pi Ms^{Y}(T)\} \quad (1)$$

Where, $\gamma$ is a gyromagnetic ratio, $\gamma=2.8$ MHz/Oe; Hg is a D.C. bias magnetic field; $Nz^{Y}$ is a demagnetization factor of the YIG thin film, which factor is calculated by using a magnetostatic mode theory; and $4\pi Ms^{Y}$ is a saturation magnetization of the YIG. All of f, Hg and $4\pi Ms^{Y}$ is a function of temperature T. In one example of perpendicular resonance of a YIG disk having an aspect ratio (thickness/diameter) of 0.01, the demagnetization factor $Nz^{Y}$ is 0.9774, and the saturation magnetization $4\pi Ms^{Y}$ is 1916 G (Gauss) at −20° C., and 1622 G at +60° C., supposing that the bias magnetic field Hg is constant irrespective of temperature. Accordingly, the resonance frequency f is varied 835 MHz in the temperature range of −20° C. to +60° C.

In order to avoid deviation in the resonance frequency due to environmental temperature in the YIG thin film microwave apparatus, there has been proposed a method for maintaining the YIG thin film magnetic resonance device at a constant temperature by locating the device in a thermostatic chamber, or a method for maintaining the resonance frequency of the device constant by changing a magnetic field in dependence on temperature by means of an electromagnet. However, such a method as above necessitates an external energy supply means such as a current controller to make the constitution complicated.

OBJECT AND SUMMARY OF THE INVENTION

It is an object of the present invention to provide a YIG thin film microwave apparatus which obviates the aforementioned problem, that is, which eliminates the necessity of an external circuit for compensating for the temperature characteristics, and also eliminates power consumption for compensating the temperature characteristics.

It is another object of the present invention to provide a YIG thin film microwave apparatus which may be used both at a fixed frequency and a variable frequency.

It is a further object of the present invention to provide a YIG thin film microwave apparatus which may satisfactorily carry out compensation of the temperature characteristics in a wide frequency range.

According to one aspect of the present invention there is provided a YIG thin film microwave apparatus which comprises a YIG thin film device utilizing ferrimagnetic resonance effect, a magnetic circuit having a gap of length lg and applying a bias magnetic field perpendicular to a film surface of the YIG thin film device, the magnetic circuit including a permanent magnet having a thickness lm and a soft magnetic plate having a thickness lx, the permanent magnet satisfying the characteristics $$Br^{o} > (fo/\gamma) + Nz^{Y}4\pi Mso^{Y}$$

$$\alpha_1^{B} > \frac{Nz^{Y}4\pi Mso^{Y}}{(fo/\gamma) + Nz^{Y}4\pi Mso^{Y}} \cdot \alpha_1^{Y}$$

the soft magnetic plate satisfying the characteristics $$4\pi Mso^{X} < (fo/\gamma) + Nz^{Y}4\pi Mso^{Y}$$

$$\alpha_1^{x} < \frac{Nz^{Y}4\pi Mso^{Y}}{(fo/\gamma) + Nz^{Y}4\pi Mso^{Y}} \cdot \alpha_1^{Y}$$

wherein fo is resonance frequency of the YIG thin film device, $\gamma$ is gyromagnetic ratio of the YIG thin film $Nz^{Y}$ is demagnetization factor of the YIG thin film $4\pi Mso^{Y}$ is saturation magnetization of the YIG thin film at room temperature, $4\pi Mso^{x}$ is saturation magnetization of the soft magnetic plate, $Br^{o}$ is remanence of the permanent magnet at room temperature, $\alpha_1^{B}$ is first order temperature coefficient of the remanence of the permanent magnet near room temperature, $\alpha_1^{Y}$ is first order temperature coefficient of the saturation magnetization of the YIG thin film near room temperature, $\alpha_1^{x}$ is first order temperature coefficient of the saturation magnetization of the soft magnetic plate near room temperature and, the thickness lm and lx being selected to improve temperature dependency of the resonance frequency.

According to another aspect of the present invention there is provided a microwave apparatus of the above construction in which the YIG thin film is formed of substituted YIG material, where trivalent iron ion $Fe^{3+}$ in YIG is partially substituted with non-magnetic ion. Thus temperature compensation can be achieved by selecting the thickness of the permanent magnet lm, the thickness of the soft magnetic plate lx and the substituted amount $\delta$ expressed as formula unit.

BRIEF DESCRIPTION OF THE DRAWINGS

Referring to FIG. 1 which shows a YIG thin film microwave apparatus of the present invention, reference numeral 1 designates a microwave device of a YIG thin film and strip lines electromagnetically coupled to the YIG thin film, and reference numeral 2 designates a magnetic circuit for applying a bias magnetic field to the microwavedevice 1. In one example, the magnetic-circuit 2 comprises a U-shaped yoke 3, permanent magnets 4 each having a thickness of lm and soft magnetic plates 5 made of soft ferrite, for example, each having thickness of lx. The permanent magnets 4 and the soft magnetic plates 5 are arranged on opposed surfaces at both end portions of the yoke 3 to define a magnetic gap g having a spacing of lg between both the soft magnetic plates 5. The microwave device 1 is located in the magnetic gap g.

DESCRIPTION OF THE PREFERRED EMBODIMENT

Figure 1:
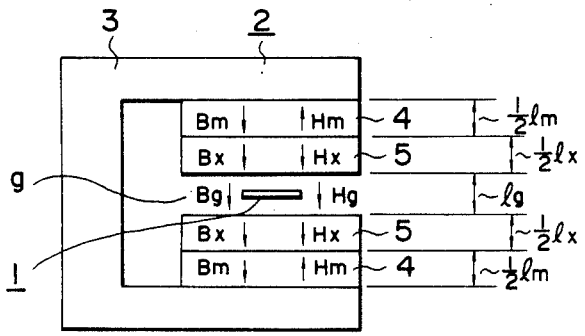
FIGS. 1, 4 and 5 are schematic views of the YIG thin film microwave apparatus of the present invention.

In the magnetic circuit as shown in FIG. 1, supposing that all magnetic fluxes pass through the magnetic gap g, and a magnetic field in the gap g is uniform, and the permeability of the yoke is infinite, the following equations are given by a Maxwell's equation.

$$Bm = Bx = Bg \tag{2}$$

$$lmHm = lgHg + lxHx \tag{3}$$

Where, Bm, Bx and Bg are magnetic flux densities in the permanent magnet 4, the soft magnetic plate 5 and the magnetic gap g, respectively; and Hm, Hx and Hg are magnetic fields in the permanent magnet 4, the soft magnetic plate 5 and the magnetic gap g, respectively, the direction of Hm is reversed so that of Hg, Hx, Bm, Bx and Bg.

Supposing that the permanent magnet 4 does not have a knee point, and a recoil permeability of the permanent magnet 4 is constant, that is, a demagnetization curve shows linearity, the following equation (4) is given.

$$Hm = \frac{1}{\mu r}(Br - Bm) = \frac{1}{\mu r}(Br - Hg) \tag{4}$$

Supposing that the soft ferrite plate 5 is sufficiently saturated, and its saturation magnetization and demagnetization factor are $4\pi Ms^x$ and $Nz^x$, respectively, the magnetic field Hx in the soft ferrite plate is expressed by the following equation (5).

$$Hx = Hg - Nz^x 4\pi Ms^x \tag{5}$$

Supposing that a change in dimension of the magnetic circuit due to thermal expansion is sufficiently small, and may be neglected, the magnetic field Hg in the gap of the magnetic circuit 2 is derived from Equations (3), (4) and (5) to give the following equation (6) as a function of temperature T.

$$Hg(T) = \frac{(lmBr(T)/\mu r) + lxNz^x 4\pi Ms^x(T)}{lg + (lm/\mu r) + lx} \tag{6}$$

In consideration of temperature coefficients $\alpha_1^B$, $\alpha_2^B$, $\alpha_1^Y$, $\alpha_2^Y$, $\alpha_1^x$ and $\alpha_2^x$ to the second order of the magnet, YIG and soft ferrite plate in a temperature range of $\pm$ several tens of °C. about room temperature To, concretely $\pm 40°$ C., the remanence Br of the permanent magnet and the saturation magnetization $4\pi Ms^y$ of YIG may be expressed with a sufficient accuracy as follows:

$$Br(T) = Br^{\circ}\{1 + \alpha_1^B(T - To) + \alpha_2^B(T - To)^2\} \tag{7}$$

$$4\pi Ms^Y(T) = 4\pi Mso^Y\{1 + \alpha_1^Y(T - To) + \alpha_2^Y(T - To)^2\} \tag{8}$$

$$4\pi Ms^x(T) = 4\pi Mso^x\{1 + \alpha_1^x(T - To) + \alpha_2^x(T - To)^2\} \tag{9}$$

To make a resonance frequency f(T) into a constant value fo independent of temperature T, it is necessary to derive the following equation (10) from Equations (1) and (6).

$$\frac{(lmBr(T)/\mu r) + lxNz^x 4\pi Ms^x(T)}{lg + (lm/\mu r) + lx} = (fo/\gamma) + Nz^Y 4\pi Ms^Y(T) \tag{10}$$

Substituting Equations (7), (8) and (9) into Equation (10), and equating each term of the 0th, 1st and 2nd orders with respect to temperature T, the following equations are given.

$$(lmBr^{\circ}/ur) + lxNz^x 4\pi Mso^x = \{lg + (lm/ur) + lx\}\{(fo/\gamma) + Nz^Y 4\pi Mso^Y\} \tag{11}$$

$$(lmBr^{\circ}\alpha_1^B/ur) + lxNz^x 4\pi Mso^x \alpha_a^x = \{lg + (lm/ur) + lx\} Nz^Y 4\pi Mso^Y \alpha_1^Y \tag{12}$$

$$(lmBr^{\circ}\alpha_2^B/ur) + lxNz^x 4\pi Mso^x \alpha_2^x = \{lg + (lm/ur) + lx\} Nz^Y 4\pi Mso^Y \alpha_2^Y \tag{13}$$

Assuming that each material for the YIG, permanent magnet and soft magnetic plate is given, and the spacing lg of the magnetic gap is also given, it is impossible to obtain the combination of lm and lx simultaneously satisfying Equations (11), (12) and (13).

Accordingly, the coefficients of the 0th order and the 1st order as primary terms are equalized. Namely, the values lm and lx satisfying Equations (11) and (12) are given as follows:

$$lm = \frac{\mu r lg Nz^x 4\pi Mso^x \left\{ \frac{\alpha_1{}^x}{Nz^Y 4\pi Mso^Y \alpha_1{}^Y} - \frac{1}{(fo/\gamma) + Nz^Y 4\pi Mso^Y} \right\}}{\left\{ \frac{Br^o}{(fo/\gamma) + Nz^Y 4\pi Mso^Y} - 1 \right\} \left\{ \frac{Nz^x 4\pi Mso^x \alpha_1{}^x}{Nz^Y 4\pi Mso^Y \alpha_1{}^Y} - 1 \right\} - \left\{ \frac{Nz^x 4\pi Mso^Y}{(fo/\gamma) + Nz^Y 4\pi Mso^Y} - 1 \right\} \left\{ \frac{Br^o \alpha_1{}^B}{Nz^Y 4\pi Mso^Y \alpha_1{}^Y} - 1 \right\}} \quad (14)$$

$$lx = \frac{-lg Br^o \left( \frac{\alpha_1{}^B}{Nz^Y 4\pi Mso^Y \alpha_1{}^Y} - \frac{1}{(fo/\gamma) + Nz^Y 4\pi Mso^Y} \right)}{\left\{ \frac{Br^o}{(fo/\gamma) + Nz^Y 4\pi Mso^Y} - 1 \right\} \left\{ \frac{Nz^x 4\pi Mso^x \alpha_1{}^x}{Nz^Y 4\pi Mso^Y \alpha_1{}^Y} - 1 \right\} - \left\{ \frac{Nz^x 4\pi Mso^Y}{(fo/\gamma) + Nz^Y 4\pi Mso^Y} - 1 \right\} \left\{ \frac{Br^o \alpha_1{}^B}{Nz^Y 4\pi Mso^Y \alpha_1{}^Y} - 1 \right\}} \quad (15)$$

It is appreciated from Equations (14) and (15) that the following conditions must be established so as to let lm and lx have a positive solution.

$$Br^o > (fo/\gamma) + Nz^Y 4\pi Mso^Y \quad (16)$$

$$Nz^x 4\pi Mso^x < (fo/\gamma) + Nz^Y 4\pi Mso^Y \quad (17)$$

$$\alpha_1{}^B > \frac{Nz^Y 4\pi Mso^Y}{(fo/\gamma) + Nz^Y 4\pi Mso^Y} \cdot \alpha_1{}^Y \quad (18)$$

$$\alpha_1{}^x < \frac{Nz^Y 4\pi Mso^Y}{(fo/\gamma) + Nz^Y 4\pi Mso^Y} \cdot \alpha_1{}^Y \quad (19)$$

Since $Nz \leqq 1$ in Expression (17), it is appreciated that Expression (17) always holds if the following condition is established.

$$4\pi Mso^x < (fo/\gamma) + Nz^Y 4\pi Mso^Y \quad (20)$$

Accordingly, good temperature characteristics may be achieved by combining a permanent magnet material having a remanence Br at room temperature greater than $(fo/\gamma)+Nz^Y 4\pi Mso^Y$ and a 1st order temperature coefficient $\alpha_1{}^B$ of the remanence Br near the room temperature greater than $Nz^Y 4\pi Mso^Y.\alpha_1{}^Y/\{(fo/\gamma)+Nz^Y 4\pi Mso^Y\}$, with a so-called soft magnetic plate having a saturation magnetization $4\pi Mso^Y$ at room temperature smaller than $(fo/\gamma)+Nz^Y 4\pi Mso^Y$ and a 1st order temperature coefficient $\alpha_1{}^x$ of the saturation magnetization $4\pi Ms^x$ near the room temperature smaller than $Nz^Y 4\pi Mso^Y.\alpha_1{}^Y/\{(fo/\gamma)+Nz^Y 4\pi Mso^Y\}$.

EMBODIMENT 1

Figure 2:
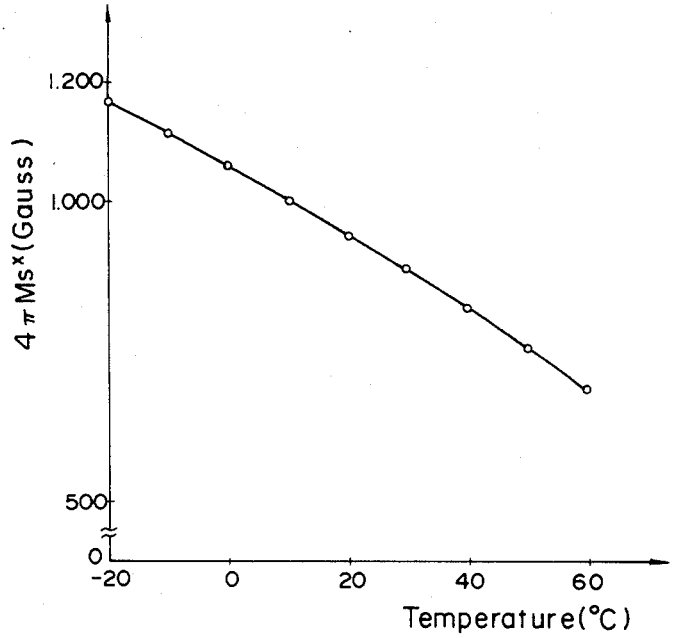
FIG. 2 is a graph illustrating the temperature characteristics of saturation magnetization of Mg-Mn-Al ferrite.

In the structure shown in FIG. 1, the soft magnetic plate 5 is formed of Mg-Mn-Al ferrite having temperature characteristics as shown in FIG. 2, and the permanent magnet 4 is formed of any of $Nd_2Fe_{14}B$ magnet having $Br=11000$ G, $\alpha_1{}^B=-1.2\times10^{-3}$ and $\alpha_2{}^B=-0.75\times10^{-6}$, $CeCO_5$ magnet having $Br=6000$ G, $\alpha_1{}^B=-0.9\times10^{-3}$ and $\alpha_2{}^B=0$, and $SmCo_5$ magnet having $r=8500$ G, $\alpha_1{}^B=-0.5\times10^{-3}$ and $\alpha_2{}^B=0$. The thicknesses lx and lm and frequency deviation Δf in consideration of the 2nd order coefficient in the temperature range of −20° C. to +60° C. are as shown in Table I, Table II and Table III.

TABLE I

| fo(GHz) | Table showing center frequency of YIG and variation thereof lm(mm) | lx(mm) | Δf(MHz) |
|---|---|---|---|
| 1.0 | 0.885 | 1.089 | ±5.82 |
| 2.0 | 1.013 | 0.609 | ±3.97 |
| 3.0 | 1.124 | 0.195 | ±2.12 |

TABLE I-continued

| fo(GHz) | Table showing center frequency of YIG and variation thereof lm(mm) | lx(mm) | Δf(MHz) |
|---|---|---|---|
| 4.0 | | <0 | |

Br = 10000 G
$\alpha_1{}^B = 1.20 \times 10^{-3}$
$\alpha_2{}^B = 7.5 \times 10^{-7}$
$\mu r = 1.05$

TABLE II

| fo(GHz) | Table showing center frequency of YIG and variation thereof lm(mm) | lx(mm) | Δf(MHz) |
|---|---|---|---|
| 1.0 | 2.401 | 2.646 | ±5.88 |
| 2.0 | 3.020 | 2.190 | ±4.04 |
| 3.0 | 3.665 | 1.715 | ±2.21 |
| 4.0 | 4.335 | 1.222 | ±0.37 |
| 5.0 | 5.034 | 0.707 | ±1.46 |
| 6.0 | 5.762 | 0.171 | ±3.29 |
| 7.0 | | <0 | |

Br = 6000 G
$\alpha_1{}^B = -9.00 \times 10^{-4}$
$\alpha_2{}^B = 0$
$\mu r = 1.01$

TABLE III

| fo(GHz) | Table showing center frequency of YIG and variation thereof lm(mm) | lx(mm) | Δf(MHz) |
|---|---|---|---|
| 1.0 | 1.701 | 3.956 | ±9.66 |
| 2.0 | 2.183 | 3.826 | ±8.71 |
| 3.0 | 2.706 | 3.685 | ±7.76 |
| 4.0 | 3.274 | 3.532 | ±6.81 |
| 5.0 | 3.894 | 3.365 | ±5.86 |
| 6.0 | 4.574 | 3.182 | ±4.91 |
| 7.0 | 5.323 | 2.980 | ±3.96 |
| 8.0 | 6.151 | 2.757 | ±3.01 |
| 9.0 | 7.071 | 2.510 | ±2.06 |
| 10.0 | 8.101 | 2.232 | ±1.11 |
| 11.0 | 9.261 | 1.920 | ±0.16 |
| 12.0 | 10.576 | 1.566 | ±0.79 |
| 13.0 | 12.082 | 1.160 | ±1.74 |
| 14.0 | 13.822 | 0.692 | ±2.69 |
| 15.0 | 15.856 | 0.144 | ±3.64 |
| 16.0 | | <0 | |

Br = 8500 G
$\alpha_1{}^B = -5.00 \times 10^{-4}$
$\alpha_2{}^B = 0$
$\mu r = 1.01$ In the above, the gap spacing lg was set to 3 mm, and $4\pi Mso^x=943.8$ G, $\alpha_1{}^x=-6.38\times10^{-3}$ and $a_2{}^x=-1.40\times10^{-5}$ were set in view of FIG. 2. In this case, it is appreciated that the conditions of Expressions (20) and (18) always hold irrespective of the frequency fo. Furthermore, as in apparent from Tables I to III, the realizable frequency fo has a certain range according to the kind of the permanent magnet used.

Figure 3:
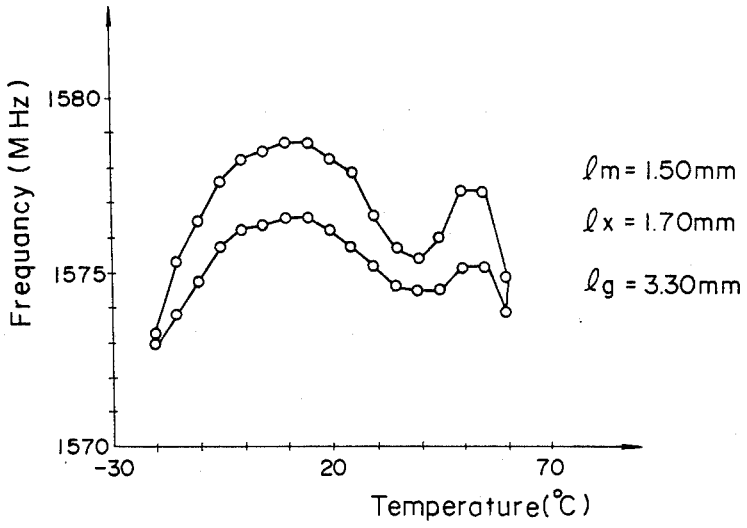
FIGS. 3 and 6 are graphs illustrating the temperature characteristics of resonance frequency in a preferred embodiment of the microwave apparatus of the present invention.

FIG. 3 shows temperature characteristics of resonance frequency of YIG in the case that the magnetic circuit 2 is formed by the combination of the Mg-Mn-Al solt ferrite plate 5 and the $Nd_2Fe_{14}B$ magnet 4. As is apparent from FIG. 3, the frequency variation Δf falls within a range of ±2.9 MHz with respect to a center frequency of 1.575 GHz in the temperature range of −20° C. to +60° C.

Although the magnetic circuit 2 is constituted of one kind of the permanent magnet 4 and one kind of the soft ferrite plate 5 in the aforementioned embodiment, two kinds of magnet and one kind of soft ferrite plate may be combined to form the magnetic circuit.

Figure 4:
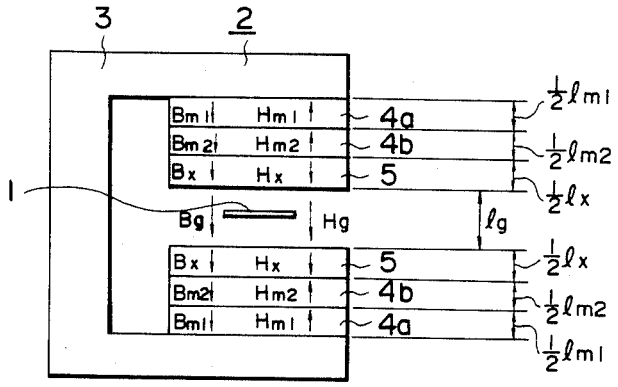

FIG. 4 shows the magnetic circuit 2 formed by combining two kinds of permanent magnets 4*a* and 4*b* with the soft ferrite plate 5. In this case, the following equation (21) corresponding to Equation (6) is derived.

$$Hg(T) = \frac{(lm_1 Br_1(T)/\mu r_1) + (lm_2 Br_2(T)/\mu r_2) + (lx Nz^x 4\pi Ms^x(T))}{lg + (lm_1/\mu r_1) + (lm_2/\mu r_2) + lx} \quad (21)$$

Where, $Br_1$ and $Br_2$ are remanences of the permanent magnets 4*a* and 4*b*, respectively; $\mu r_1$ and $\mu r_2$ are recoil permeabilities of the permanent magnets 4*a* and 4*b*, respectively; and $lm_1$ and $lm_2$ are total thicknesses of the permanent magnets 4*a* and 4*b*, respectively.

Representing the sum of respective thicknesses of the permanent magnets 4*a* and 4*b* by $lm^t$ the following equation is given.

$$lm^t = lm_1 + lm_2 \quad (22)$$

Representing an average recoil permeability of the whole of the permanent magnets 4*a* and 4*b* by $\widetilde{\mu r}$, $lm^t/\widetilde{\mu r} = (lm_1/\mu r_1) + (lm_2/\mu r_2)$ is given, and the following equation is derived therefrom.

$$\begin{aligned} \widetilde{\mu r} &= \frac{lm^t}{(lm_1/\mu r) + (lm_2/\mu r_2)} \\ &= \frac{lm_1 + lm_2}{(lm_1/\mu r_1) + (lm_2/\mu r_2)} \\ \widetilde{\mu r} &= \frac{(lm_1 + lm_2)\mu r_1 \mu r_2}{lm_1 \mu r_2 + lm_2 \mu r_1} \end{aligned} \quad (23)$$

Representing an average remanence of the permanent magnets 4*a* and 4*b* by Br(T), the following equation is given.

$$lm^t \widetilde{Br}(T)/\widetilde{\mu r} = (lm_1 Br_1(T)/\mu r) + (lm_2 Br_2(T)/\mu r_2) \quad (24)$$

$$\begin{aligned} \widetilde{Br}(T) &= \frac{(lm_1 Br_1(T)/\mu r_1) + (lm_2 Br_2(T)/\mu r_2)}{lm^t/\widetilde{\mu r}} \\ &= \frac{(lm_1/\mu r_1)\, Br_1(T) + (lm_2/\mu r_2)\, Br_2(T)}{(lm_1/\mu r_1) + (lm_2/\mu r_2)} \end{aligned}$$

Substituting the following equations into Equations (24), $$\begin{aligned} \widetilde{Br}(T) &= \widetilde{Br}^o\{1 + \widetilde{\alpha_1}^B(T - To) + \widetilde{\alpha_2}^B(T - To)^2\} \\ BR_1(T) &= Br_1^o\{1 + \alpha_1^{B1}(T - To) + \alpha_2^{B1}(T - To)^2\} \\ BR_2(T) &= Br_2^o\{1 + \alpha_1^{B2}(T - To) + \alpha_2^{B2}(T - To)^2\} \end{aligned}$$

and comparing each term of the 0th, 1st and 2nd orders with respect to the temperature on both sides, the following equation is obtained.

$$\widetilde{Br}^o = \frac{(lm_1/\mu r_1) \cdot Br_1^o + (lm_2/\mu r_2) \cdot Br_2^o}{(lm_1/\mu r_1) + (lm_2/\mu r_2)} \quad (25)$$

$$\widetilde{\alpha_1}^B = \frac{(lm_1 Br_1^o/\mu r_1) \cdot \alpha_1^{B1} + (lm_2 Br_2^o/\mu r_2) \cdot \alpha_1^{B2}}{(lm_1 Br_1^o/\mu r_1) + (lm_2 Br_2^o/\mu r_2)}$$

$$\widetilde{\alpha_2}^B = \frac{(lm_1 Br_1^o/\mu r_1) \cdot \alpha_2^{B1} + (lm_2 Br_2^o/\mu r_2) \cdot \alpha_2^{B2}}{(lm_1 Br_1^o/\mu r_1) + (lm_2 Br_2^o/\mu r_2)}$$

Representing a ratio of the thickness of the permanent magnets 4*a* and 4*b* by $a = lm_1/lm_2$, a ratio of the recoil permeabilities of the permanent magnets 4*a* and 4*b* by $b = \mu r_1/\mu r_2$, and a ratio of the remanences of the permanent magnets 4*a* and 4*b* at room temperature by $c = Br_1^o/Br_2^o$, Equation (25) can be expressed as follows:

$$\widetilde{Br}^o = \frac{(a/b) \cdot Br_1^o + Br_2^o}{(a/b) + 1} \quad (26)$$

$$\widetilde{\alpha_1}^B = \frac{(ac/b) \cdot \alpha_1^{B1} + \alpha_1^{B2}}{(ac/b) + 1}$$

$$\widetilde{\alpha_2}^B = \frac{(ac/b) \cdot \alpha_2^{B1} + \alpha_2^{B2}}{(ac/b) + 1}$$

Defining each parameter as mentioned above, Equation (21) can be expressed in the same form as Equation (6) as follows:

$$Hg(T) = \frac{(lm^t \widetilde{Br}(T)/\widetilde{\mu r}) + (lx Nz^x 4\pi Ms^x(T)}{(lg + lm^t) + (\widetilde{\mu r} + lx)} \quad (27)$$

Deriving from Equation (27), the following expressions (28) and (29) corresponding to Expressions (16) and (18) can be obtained.

$$\widetilde{Br}^o > (fo/\gamma) + Nz^Y 4\pi Mso^Y \quad (28)$$

$$\widetilde{\alpha_1}^B > \frac{Nz^Y 4\pi Mso^Y}{(fo/\gamma) + Nz^Y 4\pi Mso^Y} \cdot \alpha_1^Y \quad (29)$$

In summary, provided that the ratios a, b and c are defined by $a = lm_1/lm_2$, $b = \mu r_1/\mu r_2$, and $c = Br_1^o/Br_2^o$, respectively, good temperature characteristics may be achieved by combining the permanent magnets 4*a* and 4*b* having the average remanence $\widetilde{Br}^o$ at room temperature satisfying Equation (28) and the 1st order temperature coefficient $\widetilde{\alpha_1}^B$ of the average remanence satisfying Equation (29), $\widetilde{Br}^o$ and $\widetilde{\alpha_1}^B$ being defined by Equation (26), with the soft ferrite plate having the saturation magnetization $4\pi Mso^x$ at room temperature smaller than $(fo/\gamma) + Nz^Y 4\pi Mso^Y$ and the 1st order temperature coefficient $\alpha_1^x$ of the saturation magnetization $4\pi Mso^x$ near the room temperature smaller than $Nz^Y 4\pi Mso^Y.\alpha_1{}^Y/\{(fo/\gamma)+Nz^Y 4\pi Mso^Y\}$.

As is mentioned above, the use of the soft ferrite plate in combination with two kinds of the permanent magnets 4a and 4b is more advantageous than the case of using two kinds of the permanent magnets 4a and 4b only.

In the case that two kinds of the permanent magnets only are used, the remanence Br of the permanent magnets is relatively largely varied, and it is difficult to cut the magnets after being magnetized. Therefore, it is necessary to finally adjust the gap spacing, so as to let the resonance frequency of the YIG thin film coincide with an objective frequency. However, if the gap spacing lg is changed from a set value, the temperature characteristics are disadvantageously changed.

On the contrary, in the case that the soft ferrite plate is used in combination with the permanent magnets, the temperature characteristics are so adjusted as to substantially coincide with an objective value by the soft ferrite plate, while the change of the temperature characteristics generated by the adjustment of the gap spacing due to variation in the remanence of the permanent magnets may be finally finely adjusted by the soft ferrite plate. Namely, the resonance frequency and the temperature characteristics may be simultaneously brought into accordance with the objective value.

Figure 5:
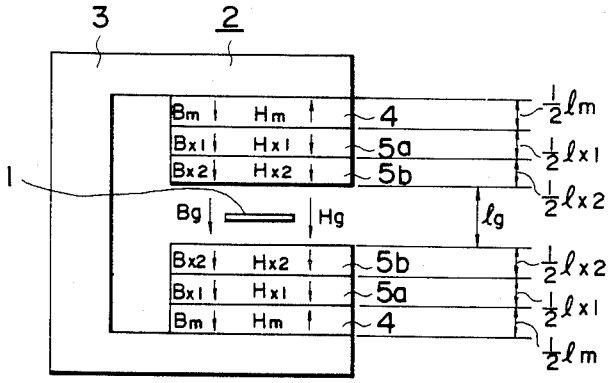

FIG. 5 shows the magnetic circuit 2 using one kind of the permanent magnet 4 and two kinds of first and second soft ferrite plates 5a and 5b formed of different materials.

In this case, the following equation (30) corresponding to Equation (6) is derived.

$$Hg(T) = \frac{(lmBr(T)/\mu r) + lx_1 Nz^{x1} 4\pi Ms^{x1}(T)\, lx_2 Nz^{x2} 4\pi Ms^{x2}(T)}{lg + (lm/\mu r) + lx_1 + lx_2} \quad (30)$$

Where, $4\pi Ms^{x1}$ and $4\pi Ms^{x2}$ are saturation magnetizations of the first and second soft ferrite plates 5a and 5b, respectively; $Nz^{x1}$ and $Nz^{x2}$ are demagnetization factors of the soft ferrite plates 5a and 5b, respectively; and $lx_1$ and $lx_2$ are total thicknesses of the soft ferrite plates 5a and 5b, respectively.

Representing the sum of respective thicknesses of the soft ferrite plates 5a and 5b by $lx^t$ the following equation is given.

$$lx^t = lx_1 + lx_2 \quad (31)$$

Representing an average demagnetization of the soft ferrite plates 5a and 5b by $\widetilde{Nz}^x$ and an average saturation magnetization of the soft ferrite plates 5a and 5b by $4\pi Ms^x(T)$, the following equation is given.

$$lx^t \widetilde{Nz}^x.4\widetilde{\pi Ms}^x(T) = lx_1 Nz^{x1} 4\pi Ms^{x1}(T) + lx_2 Nz^{x2} 4\pi Ms^{x2}(T)$$

Therefore, the following equation is obtained.

$$\widetilde{Nz}^Y \cdot 4\widetilde{\pi Mso}^x = \frac{lx_1 Nz^{x1} 4\pi Mso^{x1} + lx_2 Nz^{x2} 4\pi Mso^{x2}}{lx_1 + lx_2} \quad (33)$$

$$\widetilde{\alpha_1}^x = \frac{lx_1 Nz^{x1} 4\pi Mso^{x1} \cdot \alpha_1^{x1} + lx_2 Nz^{x2} 4\pi Mso^{x2} \cdot \alpha_1^{x2}}{lx_1 Nz^{x1} 4\pi Mso^{x1} + lx_2 Nz^{x2} 4\pi Mso^{x2}}$$

-continued $$\widetilde{\alpha_2}^x = \frac{lx_1 Nz^{x1} 4\pi Mso^{x1} \cdot \alpha_2^{x1} + lx_2 Nz^{x2} 4\pi Mso^{x2} \cdot \alpha_2^{x2}}{lx_1 Nz^{x1} 4\pi Mso^{x1} + lx_2 Nz^{x2} 4\pi Mso^{x2}}$$

Substituting the following equations into Equation (32), $$4\pi \widetilde{Ms}^x(T) = 4\pi \widetilde{Mso}^x\{1+\alpha_1{}^x(T-To)+\alpha_2{}^x(T-To)^2\}$$

$$4\pi Ms^{x1}(T) = 4\pi Mso^{x1}\{1+\alpha_1{}^{x1}(T-To)+\alpha_2{}^{x1}(T-To)^2\}$$

$$4\pi Ms^{x2}(T) = 4\pi Mso^{x2}\{1+\alpha_1{}^{x2}(T-To)+\alpha_2{}^{x2}(T-To)^2\}$$

and comparing each term of the 0th, 1st and 2nd orders with respect to the temperature on both sides, the following equation is obtained.

$$\widetilde{Nz}^x \cdot 4\pi \widetilde{Ms}^x(T) = \frac{lx_1 Nz^{x1} 4\pi Ms^{x1}(T) + lx_2 Nz^{x2} 4\pi Ms^{x2}(T)}{lx_1 + lx_2} \quad (32)$$

Representing a ratio of the thicknesses of the soft ferrite plates 5a and 5b by $a=lx_1/lx_2$, a ratio of the demagnetization factors of the soft ferrite plates 5a and 5b by $b=Nz^{x1}/Nz^{x2}$ and a ratio of the saturation magnetizations of the soft ferrite plates 5a and 5b at room temperature by $c=4\pi Mso^{x1}/4\pi Mso^{x2}$, Equation (33) can be also expressed as follows:

$$\widetilde{Nz}^x \cdot 4\pi \widetilde{Mso}^x = \frac{aNz^{x1} 4\pi Mso^{x1} + Nz^{x2} 4\pi Mso^{x2}}{a+1} \quad (34)$$

$$\widetilde{\alpha_1}^x = \frac{abc \cdot \alpha_1^{x1} + \alpha_1^{x2}}{abc+1}$$

$$\widetilde{\alpha_2}^x = \frac{abc \cdot \alpha_2^{x1} + \alpha_2^{x2}}{abc+1}$$

Defining each parameter as mentioned above, Equation (34) can be expressed in the same form as Equation (6) as follows:

$$Hg(T) = \frac{(lmBr(T)/\mu r) = lx^t \widetilde{Nz}^x 4\pi \widetilde{Ms}^x(T)}{lg + (lm/\mu r) + lx^t} \quad (35)$$

Deriving from Equation (35), the following expressions (36) and (37) corresponding to Expressions (17) and (18) can obtained.

$$\widetilde{Nz}^x \cdot 4\pi \widetilde{Mso}^x < fo/\gamma + Nz^Y 4\pi Mso^Y \quad (36)$$

$$\widetilde{\alpha_1}^x < \frac{Nz^Y 4\pi Mso^Y}{fo/\gamma + Nz^Y 4\pi Mso^Y} \cdot \alpha_1{}^Y \quad (37)$$

In summary, provided that the ratio a, b and c are defined by $a=lx_1/lx_2$, $b=Nz^{x1}/Nz^{x2}$, and $c=4\pi Mso^{x1}./4\pi Mso^{x2}$, respectively, good temperature characteristics may be achieved by combining the soft ferrite plate having the product $\widetilde{Nz}^x.4\widetilde{\pi Mso}^x$ of the average demagnetization factor and the average saturation magnetization at room temperature, which product satisfies Equation (38), and the 1st order temperature coefficient $\alpha_1{}^x$ of the average saturation magnetization satisfying Equation (37), with the permanent magnet 4 under the aforementioned conditions, which has the remanence Br at room temperature greater than $(fo/\gamma)+Nz^Y 4\pi Mso^Y$ and the 1st order temperature coefficient $\alpha_1{}^B$ of the remanence Br near the room temperature greater than $Nz^Y 4\pi Mso^Y.\alpha_1{}^Y/\{(fo/\gamma)+Nz^Y 4\pi Mso^Y\}$.

Although the present invention is applied to a microwave apparatus using a fixed frequency in the above embodiment, it may be applied to a variable type YIG thin film microwave apparatus including a coil (not shown) wound around the yoke 3 in the magnetic circuit 2.

Figure 6:
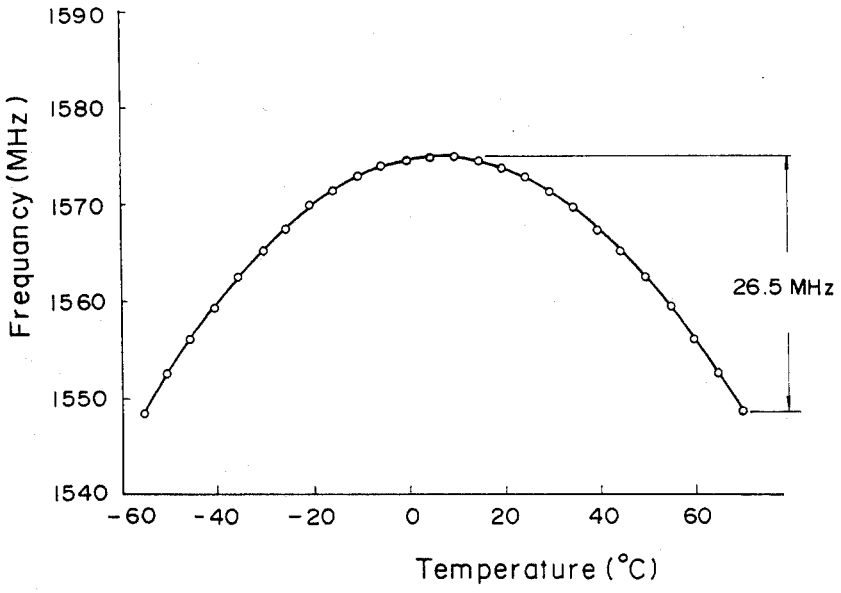

As is described above, a gradient in the temperature characteristics of the resonance frequency can be nullified by determining lm and lx satisfying Equations (11) and (12). However, a curvature of the temperature characteristics cannot be compensated by these conditions only. That is to say, as shown in FIG. 1, the magnetic circuit of the YIG thin film microwave apparatus having a center frequency of 1.575 GHz is formed by using Mg-Mn-Al ferrite having the temperature characteristics shown in FIG. 2 as the soft magnetic plate 5 and $Nd_2Fe_{14}B$ magnet as the permanent magnet 4. As to variation in the center frequency in the temperature range of −55° C. to +70° C., the microwave apparatus shows temperature characteristics having an upper convex curve with a variation range of 25.5 MHz as shown in FIG. 6. This is due to the fact that it is necessary to make a compensated part of temperature characteristics by the ferrite large as the center frequency of the microwave device is lowered, resulting that the upper convex curve exhibited by the ferrite is largely reflected on the temperature characteristics of the YIG thin film microwave apparatus. According to the present invention, the microwave device 1 is constituted of a substitution type YIG, and accordingly the compensated part of temperature characteristics by the ferrite may be reduced to nullify the upper convex curvature when a substituted quantity $\delta$ is zero. In other words, three unknown quantities consisting of the substituted quantity $\delta$ of the substitution type YIG, the thickness lm of the permanent magnet and the thickness lx of the soft ferrite plate may be determined so as to simultaneously satisfy Equations (11), (12) and (13), and accordingly the curvature of the temperature characteristics as well as the gradient may be nullfied. If materials of the permanent magnet and the ferrite, the shape of the YIG thin film, resonance frequency and gap spacing are previously given, $Br^o$, $\alpha_1{}^B$, $\alpha_2{}^B$, $\mu r$, $4\pi Mso^x$, $\alpha_1{}^x$, $\alpha_2{}^x$, $Nz^Y$, $fo/\gamma$, and lg are constants as predetermined. $Nz^Y$ is not an independent variable since it is determined by the thickness lx of the ferrite. Further, if the substituted quantity $\delta$ of a non-magnetic ion for $Fe^{3+}$ ion in the YIG is determined, $4\pi Mso^Y$, $\alpha_1{}^Y$ and $\alpha_2{}^Y$ are also determined. After all, the independent unknown quantities comprise $\delta$, lm and lx. Accordingly, if the three unknown quantities $\delta$, lm and lx are determined from Equations (11), (12) and (13), these are conditions for obtaining a fixed resonance frequency fo in consideration of the temperature characteristics to the 2nd order. That is to say, if the substitution type YIG thin film microwave device is used, and the substituted quantity $\delta$ is selected, the curvature of the temperature characteristics may be also compensated.

EMBODIMENT 2

In connection with the arrangement shown in FIG. 1, the microwave device 1 is formed by a substitution type YIG thin film, e.g., a thin film formed by substituting a trivalent non-magnetic ion such as $Ga^{3+}$ and $Al^{3+}$ for a part of $Fe^{3+}$ of YIG, or by combining divalent and tetravalent non-magnetic ions $Ca^{2+}$ and $Ge^{4+}$ to equivalently substitute a trivalent ion for $Fe^{3+}$ of YIG.

Figure 7:
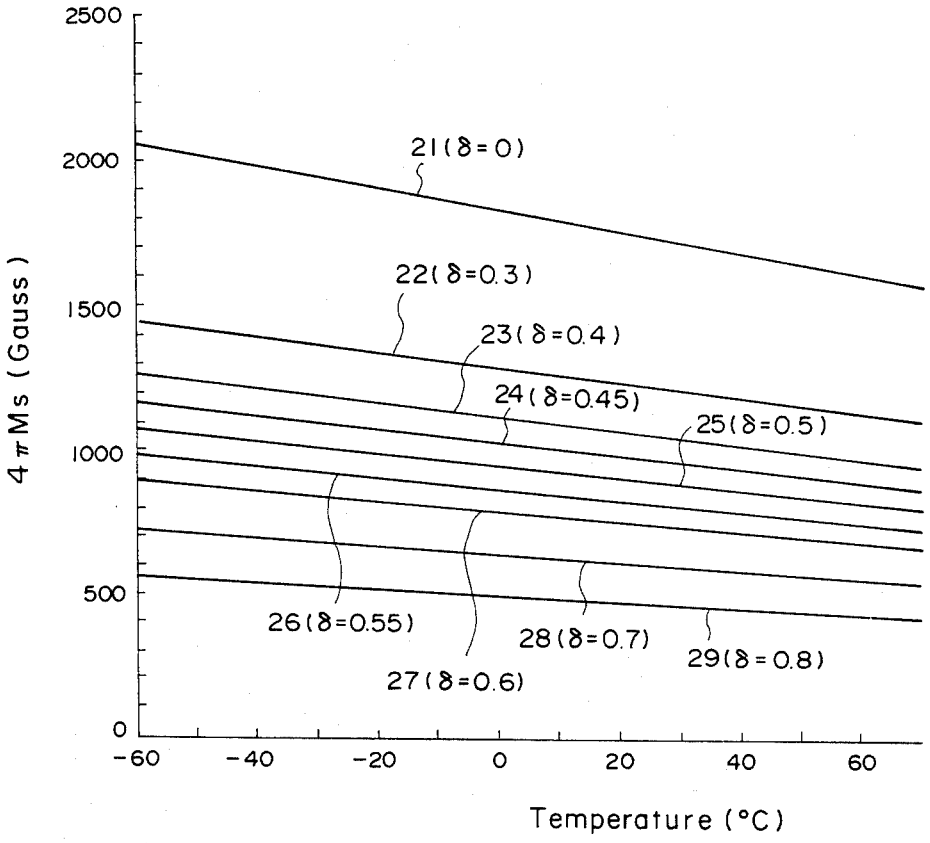
FIG. 7 is a graph illustrating the temperature characteristics of saturation magnetization of the YIG.

Now, investigated is a change in saturation magnetization of the substitution type YIG, that is, a change in saturation magnetization due to substitution of the non-magnetic ion for $Fe^{3+}$ ion of YIG. First, investigated is the change as to a pure single crystal of YIG. In the pure single crystal of YIG ($Y_3Fe_5O_{12}$), three $Fe^{3+}$ ions are located at the tetrahedral site, and two $Fe^{3+}$ ions are located at the octahedral site. The $Fe^{3+}$ ions at the tetrahedral site and the $Fe^{3+}$ ions at the octahedral site are arranged in antiparallel relation with each other by strong negative superexchange interaction. As a result, the saturation magnetization of YIG is dependent on a magnetic moment of 5 Bohr magneton (5 $\mu$B) owned by one $Fe^{3+}$ ion remaining as the result of balance of the five $Fe^{3+}$ ions in the antiparallel arrangement. In the case that a trivalent ion, e.g., $Ga^{3+}$ is substituted for a part of the $Fe^{3+}$ ions of the pure YIG all of, the trivalent ion is substituted for the $Fe^{3+}$ ions at the tetrahedral site if a substituted quantity $\delta$ is not so large. Therefore, the magnetic moment in one molecule is given as follows:

Accordingly, the saturation magnetization is reduced. The saturation magnetization of Ga substituted YIG is reported in J. of Applied Physics Vol. 45, No. 6, 6, 1974, p. 2728–2730. Using Equations (1) to (4) in this literature, and examining a change in the saturation magnetization with respect to temperature when Ga substituted quantity is changed, there may be obtained the characteristics as shown in FIG. 7. Referring to FIG. 7, curved lines (21) to (29) correspond to the substituted quantities $\delta$=0, 0.3, 0.4, 0.45, 0.5, 0.55, 0.6, 0.7 and 0.8, respectively. Further, there are shown in Table IV calculated values of the saturation magnetization $4\pi Mso^Y$ at a central temperature of 7.5° C. and the 1st and 2nd order temperature coefficient $\alpha_1{}^Y$ and $\alpha_2{}^Y$ at −55° C. to +70° C. with respect to each of the Ga substituted quantities $\delta$, which values are obtained by a method of least square.

TABLE IV

Table showing calculated values of saturation magnetization and temp. coefficients with respect to Ga substituted quantity $Y_3Fe_5$—$\delta Ga\delta O_{12}$
Temp: −55° C.~+70° C.

| $\delta$ | $4\pi$Ms(Gauss) | $\alpha_1{}^Y$ | $\alpha_2{}^Y$ |
|---|---|---|---|
| 0 | 1817.3 | $-1.9984 \times 10^{-3}$ | $-9.1474 \times 10^{-7}$ |
| 0.3 | 1277.1 | $-2.1336 \times 10^{-3}$ | $-1.6778 \times 10^{-6}$ |
| 0.4 | 1107.9 | $-2.1731 \times 10^{-3}$ | $-2.0601 \times 10^{-6}$ |
| 0.45 | 1025.7 | $-2.1902 \times 10^{-3}$ | $-2.2898 \times 10^{-6}$ |
| 0.5 | 945.2 | $-2.2047 \times 10^{-3}$ | $-2.5498 \times 10^{-6}$ |
| 0.55 | 866.4 | $-2.2157 \times 10^{-3}$ | $-2.8497 \times 10^{-6}$ |
| 0.6 | 789.4 | $-2.2219 \times 10^{-3}$ | $-3.1946 \times 10^{-6}$ |
| 0.7 | 641.0 | $-2.2121 \times 10^{-3}$ | $-4.0739 \times 10^{-6}$ |
| 0.8 | 500.7 | $-2.1510 \times 10^{-3}$ | $-5.3324 \times 10^{-6}$ |

Then, the soft magnetic plate 5 shown in FIG. 1 is formed by Mg-Mn-Al ferrite having the temperature characteristics shown in FIG. 2, and the permanent magnet 4 is formed by one of $Md_2Fe_{14}B$, $CeCO_5$ and $SmCo_5$ to thereby form a YIG thin film filter having a center frequency of 1.575 GHz. In this connection, there are shown in Table V calculated values of a necessary thickness lm of the permanent magnet, necessary thickness lx of the ferrite, and frequency variation $\Delta f$ at −55° C. to +70° C.

TABLE V

Table showing calculated values of each thickness lm, lx and frequency variation Δf with respect to Ga substituted quantity fo = 1.575 GHz $Y_3Fe_5$—δGaδ$O_{12}$

| | δ | lm(mm) | lx(mm) | Δf(MHz) |
|---|---|---|---|---|
| | | $Nd_2Fe_{14}B$ magnet used | | |
| A | 0.00 | 1.071 | 0.981 | 26.52 |
| | 0.30 | 0.713 | 0.564 | 9.16 |
| | 0.40 | 0.619 | 0.426 | 2.94 |
| | 0.45 | 0.577 | 0.358 | 0.27 |
| | 0.50 | 0.538 | 0.291 | 3.49 |
| | 0.55 | 0.501 | 0.224 | 6.78 |
| | 0.60 | 0.467 | 0.158 | 10.08 |
| | 0.70 | 0.406 | 0.028 | 16.77 |
| | | $CeCo_5$ magnet used | | |
| B | 0.00 | 2.704 | 2.349 | 23.02 |
| | 0.30 | 1.498 | 1.182 | 6.41 |
| | 0.40 | 1.248 | 0.903 | 0.41 |
| | 0.45 | 1.141 | 0.777 | 2.69 |
| | 0.50 | 1.045 | 0.659 | 5.81 |
| | 0.55 | 0.959 | 0.547 | 8.99 |
| | 0.60 | 0.880 | 0.442 | 12.20 |
| | 0.70 | 0.746 | 0.248 | 18.71 |
| | | $SmCo_5$ magnet used | | |
| C | 0.00 | 1.957 | 3.989 | 44.29 |
| | 0.30 | 1.032 | 1.978 | 23.11 |
| | 0.40 | 0.851 | 1.546 | 15.74 |
| | 0.45 | 0.775 | 1.357 | 12.00 |
| | 0.50 | 0.708 | 1.183 | 8.25 |
| | 0.55 | 0.647 | 1.023 | 4.47 |
| | 0.60 | 0.592 | 0.874 | 0.69 |
| | 0.70 | 0.499 | 0.606 | 6.89 |

Figure 8:
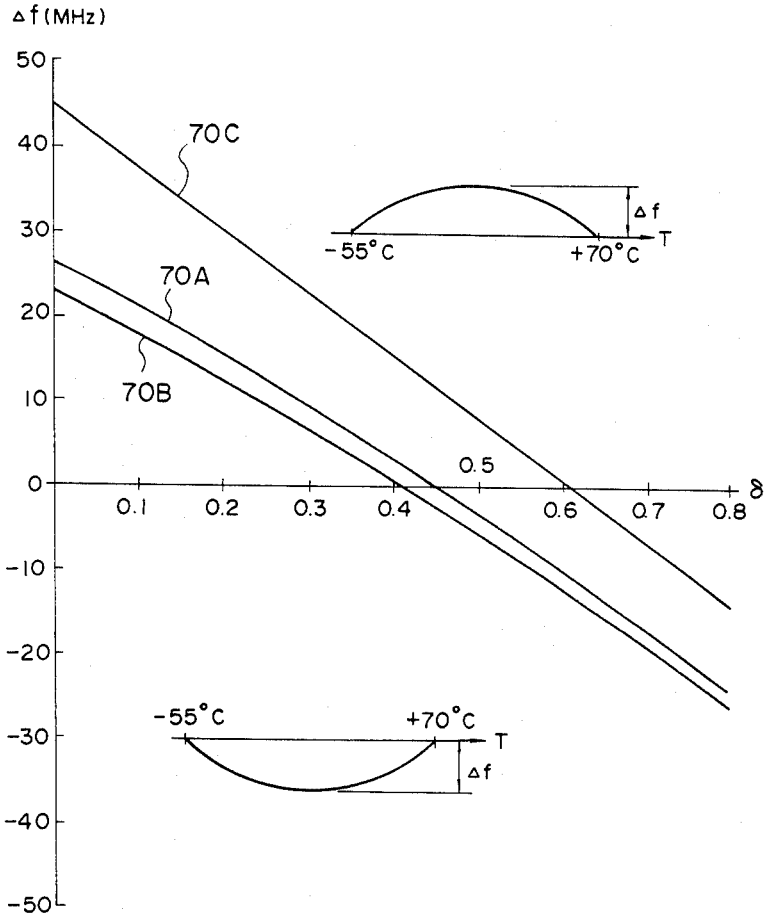
FIG. 8 is a graph illustrating the relation between a Ga substituted quantity in the YIG and a variation $\Delta f$ in resonance frequency.

A change in the frequency variation Δf with respect to the Ga substituted quantity δ is plotted in FIG. 8. Referring to FIG. 8, curved lines (70A), (70B) and (70C) correspond to the cases of using $Nd_2Fe_{14}B$ magnet, $CeCo_5$ magnet and $SmCo_5$ magnet, respectively. In all the cases, Δf is positive at δ=0, and the temperature characteristics show an upper convex curvature. Further, Δf is decreased with a decrease in δ. As δ is further decreased, Δf becomes negative, and the temperature characteristics show a lower convex curvature. Thus, it is appreciated that the temperature characteristics of Δf−0 is obtained by selecting the value of δ. In other words, according to the present invention, it is possible to nullify a gradient and curvature of the temperature characteristics of the resonance frequency of YIG by selecting a substituted quantity of a non-magnetic ion for the $Fe^{3+}$ ion in the YIG thin film of the microwave device according to materials of the permanent magnet and the soft magnetic plate.

Although the present invention is applied to a microwave apparatus using a fixed frequency in the above embodiment, it may be applied to a variable type YIG thin film microwave apparatus including a coil (not shown) wound around the yoke 3 in the magnetic circuit 2.

As is above described, according to the present invention, a microwave apparatus having good temperature characteristics may be provided by employing a permanent magnet and a soft magnetic plate each having respective specific characteristics in a magnetic circuit for applying a bias magnetic field to the microwave device 1 which utilizes magnetic resonance by the YIG thin film.

What is claimed is:

1. YIG thin film microwave apparatus comprising a YIG thin film utilizing a ferrimagnetic resonance effect, a magnetic circuit having a gap of length lg, said YIG thin film being provided with a bias magnetic field perpendicular to a film surface of said YIG thin film device, said magnetic circuit including a permanent magnet having a thickness lm and a soft magnetic plate having a thickness lx in its flux path, said permanent magnet satisfying the characteristics $$Br^o > (fo/\gamma) + Nz^Y 4\pi Mso^Y$$

$$\alpha_1{}^B > \frac{Nz^Y 4\pi Mso^Y}{(fo/\gamma) + Nz^Y 4\pi Mso^Y} \cdot \alpha_1{}^Y$$

said soft magnetic plate satisfying the characteristics $$4\pi Mso^X < (fo/\gamma) + Nz^Y 4\pi Mso^Y$$

$$\alpha_1{}^x < \frac{Nz^Y 4\pi Mso^Y}{(fo/\gamma) + Nz^Y 4\pi Mso^Y} \cdot \alpha_1{}^Y$$

wherein fo is resonance frequency of said YIG thin film device,

γ is gyromagnetic ratio of said YIG thin film $Nz^Y$ is demagnetization factor of said YIG thin film $4\pi Mso^Y$ is saturation magnetization of said YIG thin film at room temperature, $4\pi Mso^x$ is saturation magnetization of said soft magnetic plate, $Br^o$ is remanence of said permanent magnet at room temperature, $\alpha 1^B$ is first order temperature coefficient of the remanence of said permanent magnet near room temperature, $\alpha 1^Y$ is first order temperature coefficient of the saturation magnetization of said YIG thin film near room temperature, $\alpha 1^x$ is first order temperature coefficient of the saturation magnetization of said soft magnetic plate near room temperature and, said thickness lm and lx being selected to reduce temperature dependency of the resonance frequency.

2. YIG thin film microwave apparatus comprising a YIG thin film device utilizing a ferrimagnetic resonance effect, a magnetic circuit having a gap of length lg where said YIG thin film device has applied to it a bias magnetic field perpendicular to a film surface of said YIG thin film device, said magnetic circuit including a permanent magnet having a thickness m and a soft magnetic plate having a thickness lx in its flux path, said YIG thin film being formed of a substituted YIG thin film where part of $Fe^{3+}$ ion is substituted by a non magnetic metal in an atomic proportion of δ, said permanent magnet satisfying the characteristics $$Br^o > (fo/\gamma) + Nz^Y 4\pi Mso^Y$$

$$\alpha_1{}^B > \frac{Nz^Y 4\pi Mso^Y}{(fo/\gamma) + Nz^Y 4\pi Mso^Y} \cdot \alpha_1{}^Y$$

said soft magnetic plate satisfying the characteristics $$4\pi Mso^X < (fo/\gamma) + Nz^Y 4\pi Mso^Y$$

$$\alpha_1{}^x < \frac{Nz^Y 4\pi Mso^Y}{(fo/\gamma) + Nz^Y 4\pi Mso^Y} \cdot \alpha_1{}^Y$$

wherein fo is resonance frequency of said YIG thin film device $\gamma$ is gyromagnetic ratio of said YIG thin film, $Nz^Y$ is demagnetization factor of said YIG thin film $4\pi Mso^Y$ is saturation magnetization of said YIG thin film at room temperature, $4\pi Mso^x$ is saturation magnetization of said soft magnetic plate, $Br^o$ is remanence of said permanent magnet at room temperature, $\alpha 1^B$ is first order temperature coefficient of the remanence of said permanent magnet near room temperature, $\alpha 1^Y$ is first order temperature coefficient of the saturation magnetization of said YIG thin film near room temperature, $\alpha 1^x$ is first order temperature coefficient of the saturation magnetization of said soft magnetic plate near room temperature and, said thickness lm and lx and said amount $\delta$ being selected to reduce temperature dependency of the resonance frequency.

* * * * *